US010947714B2

(12) United States Patent
VandenHeuvel

(10) Patent No.: US 10,947,714 B2
(45) Date of Patent: Mar. 16, 2021

(54) AIR GAP FLOOR DRAIN

(71) Applicant: Bryan VandenHeuvel, Castle Rock, CO (US)

(72) Inventor: Bryan VandenHeuvel, Castle Rock, CO (US)

( * ) Notice: Subject to any disclaimer, the term of this patent is extended or adjusted under 35 U.S.C. 154(b) by 0 days.

(21) Appl. No.: 16/431,258

(22) Filed: Jun. 4, 2019

(65) Prior Publication Data

US 2019/0376270 A1 Dec. 12, 2019

Related U.S. Application Data

(60) Provisional application No. 62/683,867, filed on Jun. 12, 2018.

(51) Int. Cl.
*E03F 5/04* (2006.01)

(52) U.S. Cl.
CPC ..... *E03F 5/0409* (2013.01)

(58) Field of Classification Search
CPC ..... E03F 5/0409; E03F 5/041; A62C 35/68; F24F 13/222; F24H 9/16
USPC ..... 210/163, 164, 165, 166
See application file for complete search history.

(56) References Cited

U.S. PATENT DOCUMENTS 1,328,262 A 1/1920 Boosey
4,109,939 A 8/1978 Roberts
4,181,330 A 1/1980 Kojima
4,205,710 A * 6/1980 Dunicz ..... E03C 1/26 141/286
5,195,567 A * 3/1993 Tyree, Jr. ..... B67C 11/02 141/297
5,592,964 A * 1/1997 Traylor ..... E03C 1/102 137/216
5,934,331 A 8/1999 Earl
6,739,363 B2 * 5/2004 Walter ..... B67C 11/02 141/331
7,325,839 B2 2/2008 Slentz
7,784,486 B2 8/2010 Cagle
2012/0199245 A1 * 8/2012 Aviles ..... E03F 5/041 141/339

OTHER PUBLICATIONS

Airgap Kits for Preventing Backflow available on the Internet at www.plumbingsupply.com at least as early as May 16, 2019, 1 page, Exact Publication Date Unknown.
Screencapture from archive.org of website tru-gap.com titled "The Solution for Indirect Waste Piping Air Gap Installations" and dated Aug. 24, 2015 according to archive.org, 1 page.

* cited by examiner

*Primary Examiner* — Fred Prince
(74) *Attorney, Agent, or Firm* — Trenner Law Firm, LLC; Mark D. Trenner

(57) ABSTRACT

An air gap floor drain is disclosed which may provide an air gap between a floor drain aperture and one or more device drain conduits producing drain effluent. An example air gap floor drain includes a first funnel. A lid on the first funnel has one or more ports to accept the device drain conduits. A second funnel is stacked under the first funnel so that the drain effluent from the device drain conduits entering the first funnel through one or more ports passes down through the second funnel before flowing from the second funnel down into the floor drain aperture.

18 Claims, 7 Drawing Sheets

AIR GAP FLOOR DRAIN

PRIORITY CLAIM

This application claims the priority benefit of U.S. Provisional Patent Application No. 62/683,867 filed on Jun. 12, 2018 for "Air Gap Floor Drain" of Bryan VandenHeuvel, incorporated by reference in its entirety as though fully set forth herein.

BACKGROUND

Numerous devices in homes and other buildings are designed to drain through floor drains. Examples include water heaters, air conditioning coils, water softeners, and sprinkler system drain valves. However, plumbing code requires the prevention of cross connection between such devices, the floor drain, and other home equipment that drains water and is connected to the water lines.

DETAILED DESCRIPTION

An air gap floor drain is disclosed. The air gap floor drain provides an attachment point for different condensating equipment and equipment that overflows or drains into a floor drain. This equipment includes, but is not limited to water heaters, air conditioning coils, water softeners, and sprinkler system drain valves. The air gap floor drain also provides an air gap between the drain line and the floor drain that prevents a cross connection between these different drain sources and the floor drain, as may be required by code.

In an example, the air gap floor drain may serve as a replacement for the centers of floor drains. In another example, the air gap floor drain is a p-trap cut in version that includes a series of two or three cones supported by three vertical stands for support. Other configurations of the air gap floor drain may also be provided.

Before continuing, it is noted that as used herein, the terms "includes" and "including" mean, but is not limited to, "includes" or "including" and "includes at least" or "including at least." The term "based on" means "based on" and "based at least in part on."

Figure 1:
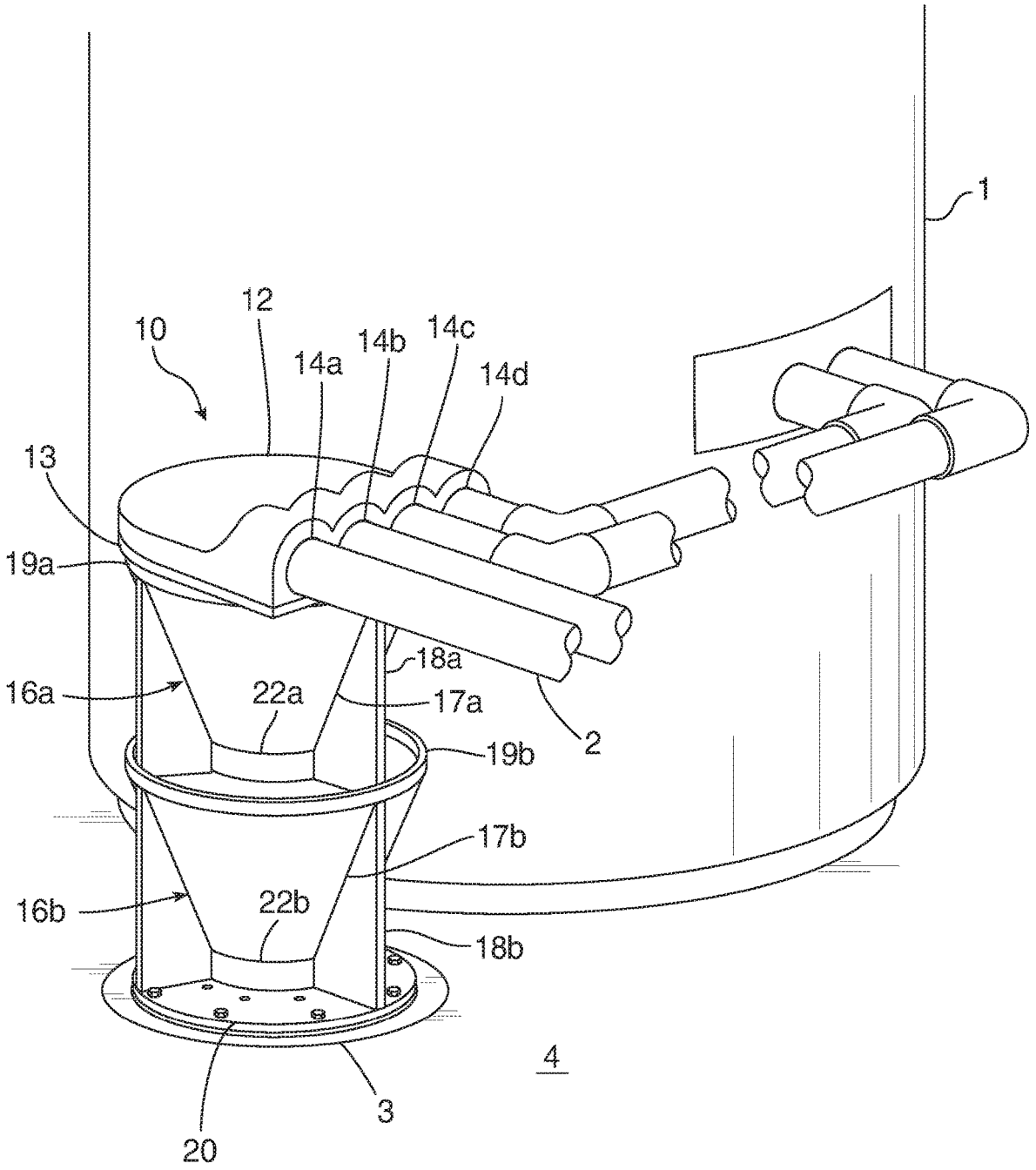
FIG. 1 is a perspective view of an example air gap floor drain as it may be implemented on a drain in the floor near a water heater in a home.

FIG. 1 is a perspective view of an example air gap floor drain 10 as it may be implemented on a drain 3 (having at least one floor drain aperture) in the floor 4 near a water heater 1 in a home. An example air gap floor drain 10 includes a lid 12 having a number of ports 14*a-d*, a first funnel 16*a* (or "cone" because of its cone-shaped sidewall 17*a*), and a second funnel 16*b* (more funnels or "cones" with sidewall 17*b* may also be provided). Drain lines 2 may be connected (e.g., from the water heater 1) to the ports 14*a-d* of the lid 12.

The first funnel 16*a* is provided in a stacked configuration on the second funnel 16*b*. In an example, the first funnel 16*a* partially nests within the second funnel 16*b*. In an example, the stack of nested funnels or cones is between about 4 inches and 6 inches tall. However, the air gap floor drain 10 is not limited in size. A plurality of support fins 18 may be provided around the first funnel 16*a* and the second funnel 16*b*, e.g., to provide stability.

The second funnel 16*b* is raised above the floor drain 3 so that an air gap is present between the floor drain aperture(s) and the bottom 22*b* of the second funnel 16*b*. The air gap floor drain 10 provides the air gap that may be desired or even required (e.g., by the plumbing code).

In an example, the lid 12 fits on top of the first funnel 16*a* to cover an interior 24*a* of the first funnel 16*a*. A plurality of ports 14*a-d* are provided on the lid 12 of the first funnel 16*a*. The ports 14*a-d* are configured to accept the drain effluent (e.g., from the water heater 1) into the interior 24*a* of the first funnel 16*a*. A fluid connection is formed between the first funnel 16*a* and the second funnel 16*b*.

During use, the drain effluent from the device drain conduits 2 (e.g., connected to the water heater 1) enters the interior 24*a* of the first funnel 16*a* through the one or more of the ports 14*a-d*. The effluent then drains down the funnel 16*a* via the fluid connection through the lower portion 26*a* into the second funnel 16*b* before flowing out of the lower portion 26*b* of the second funnel 16*b* down toward the floor drain 3 aperture(s).

The air gap floor drain 10 can be installed in an existing home (and other buildings) floor drains 3. The air gap floor drain 10 may also be incorporated as part of original construction, such that plumbing in equipment rooms of homes and other buildings is simplified in order to adhere to code. The air gap floor drain 10 may also reduce or altogether prevent splashing and mess at the site of the floor drain 3.

In an example, attachments can be made to secure the bottom funnel 16*b* to a standard floor drain 3 (e.g., connecting to the threaded screw openings already provided in the drain cover). The attachments may also include spacers to help raise the device 10 above the drain 3. For example, these attachments may assist installation if site geometry and/or other equipment make it difficult to raise the air gap drain off the floor to provide the air space or "gap" (e.g., raised by one-half inch).

Before continuing, it should be noted that the examples described above are provided for purposes of illustration, and are not intended to be limiting. Other devices and/or device configurations may be utilized to carry out the operations described herein.

Figure 2A:
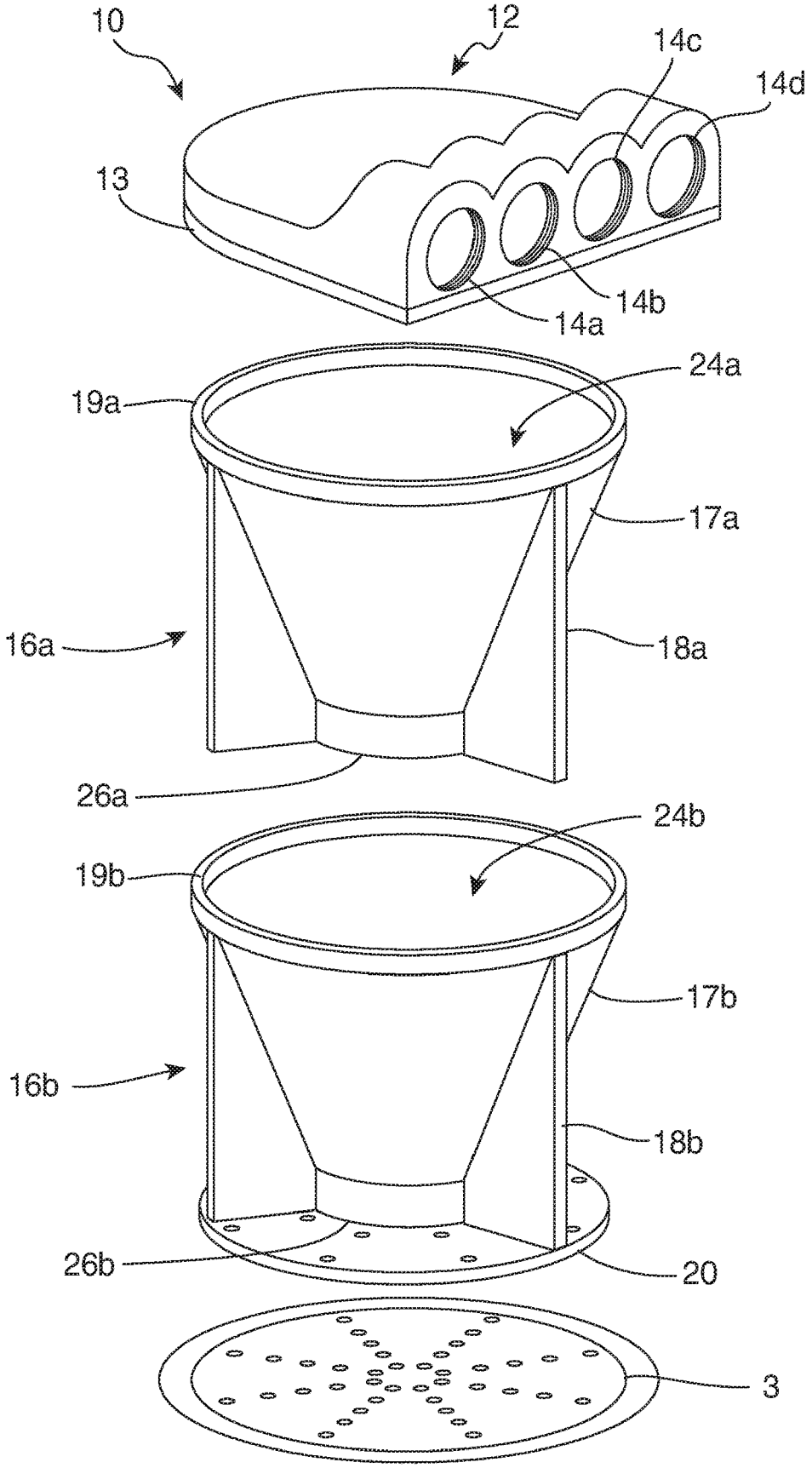
FIG. 2A is an exploded perspective view of the example air gap floor drain.
Figure 2B:
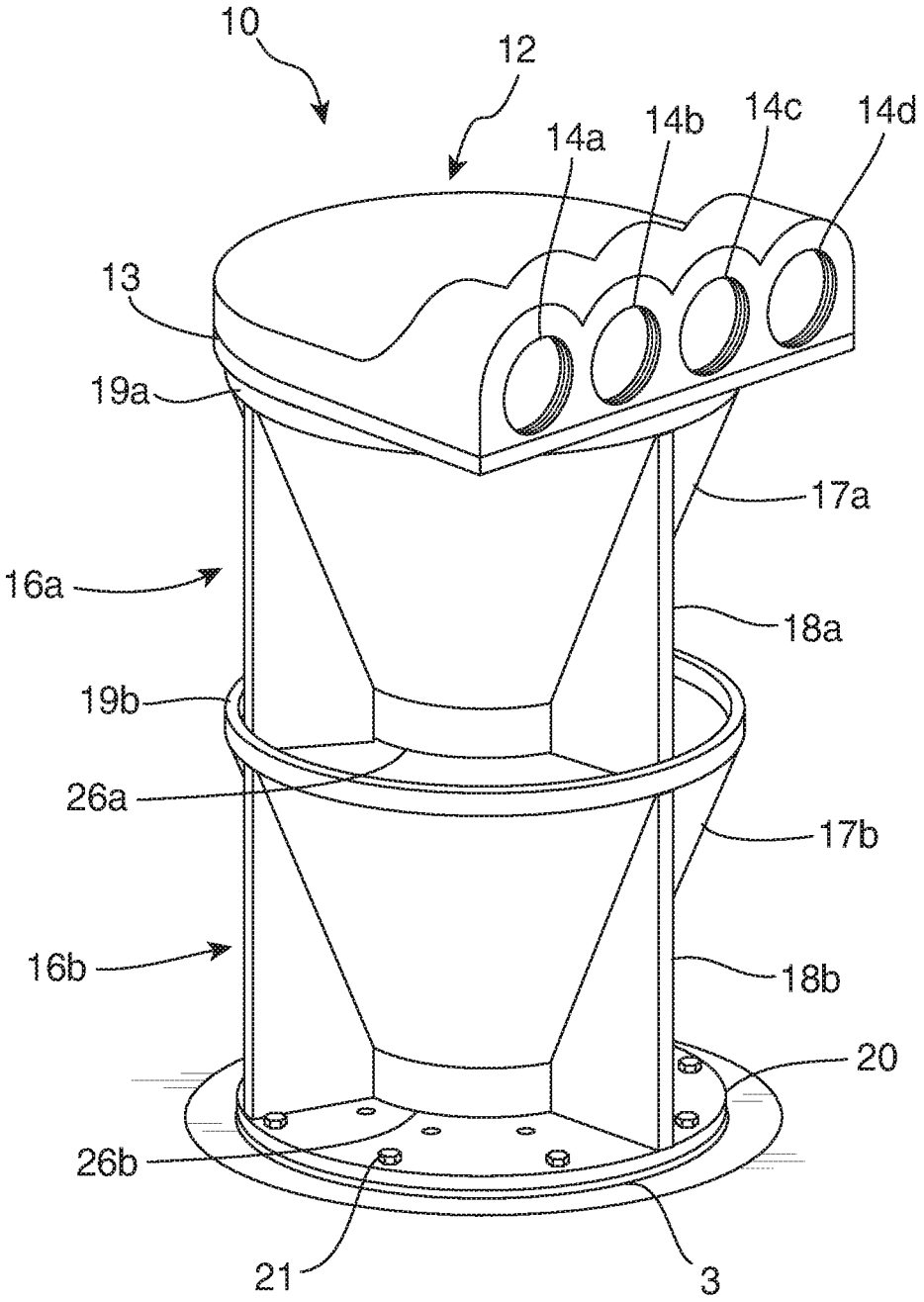
FIG. 2B is an assembled perspective view of the example air gap floor drain.

FIG. 2A is an exploded perspective view of the example air gap floor drain 10. FIG. 2B is an assembled perspective view of the example air gap floor drain 10. In an example, the air gap floor drain assembly 10 provides an air gap between a floor drain 3 aperture and one or more device drain conduits 2 producing drain effluent (see, e.g., FIG. 1).

As noted above, an example of the air gap floor drain assembly 10 includes a first funnel 16*a*, a second funnel 16*b*, and a lid or cover 12 for assembly on the first funnel 16*a*. Of course, only one, or more than two funnels (e.g., 3 or more funnels) may be provided. The lid 12 has one or more ports 14*a-d* to accept the device drain conduits 2.

In an example, the first funnel 16*a* attaches to, and nests partially within, the second funnel 16*b*. The first funnel 16*a* is stacked on the second funnel 16*b* to create a fluid connection therebetween so that the drain effluent from the device drain conduits 2 entering the first funnel 16*a* through the one or more ports 14*a-d* passes through the second funnel 16*b* before flowing from the second funnel 16*b* down into the floor drain 3 aperture.

In an example, the second funnel 16*b* is raised above the floor drain 3 aperture so that the air gap is present between the floor drain 3 aperture and the bottom of the second funnel 16*b*.

In an example, the air gap floor drain 10 includes a drain cover 20 having a plurality of openings therethrough. The drain cover 20 is provided below the second funnel 16*b*, and may attach the second funnel 16*b* to the floor drain 3, e.g., by screws 21 or other fasteners.

In an example, the air gap floor drain assembly 10 includes a plurality of fins 18*a*, 18*b* around at least one of the first and second funnels 16*a*, 16*b*, respectively. The fins 18*a*, 18*b* serve to stabilize the first and second funnels 16*a*, 16*b* in an upright orientation over the floor drain 3 aperture (e.g., from tipping sideways).

In an example, the air gap floor drain assembly 10 may also include a separate standoff mechanism that attaches to at least one of the first and second funnels 16*a*, 16*b* to support the second funnel 16*b* above the floor drain 3 aperture. For example, the support fins 18*a*, 18*b* may provide this function when provided as a separate entity and not formed as a part of the funnels 16*a*, 16*b*.

Figure 3:
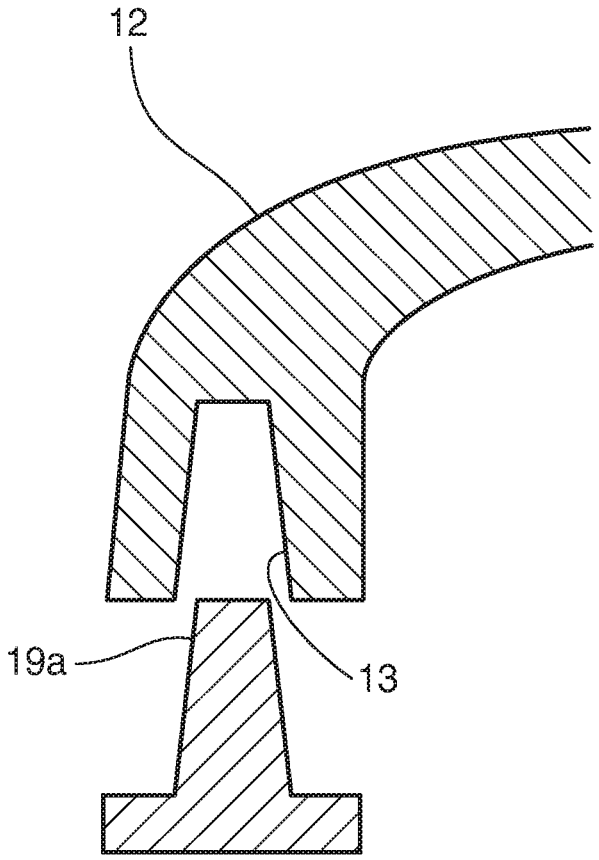
FIG. 3 is a partial cross sectional view of the lid connected to the funnel of the example air gap floor drain.

FIG. 3 is a partial cross sectional view of the lid 12 connecting to the funnel 16*a* of the example air gap floor drain 10. In an example, the lid 12 may be connected by any suitable means, such as but not limited to press-fit, threading, glue or other adhesive. In FIG. 3, the lid 12 is shown having a female seat or connection 13 that fits over and/or engages with a male seat or lip 19*a* on the funnel 16*a*. In an example, the fitting of the lid 12 to the funnel 16*a* provides a water-tight seal between the lid 12 and the interior space of the first funnel. In another example, the lid 12 may be formed as part of the funnel 16*a*.

Figure 4:
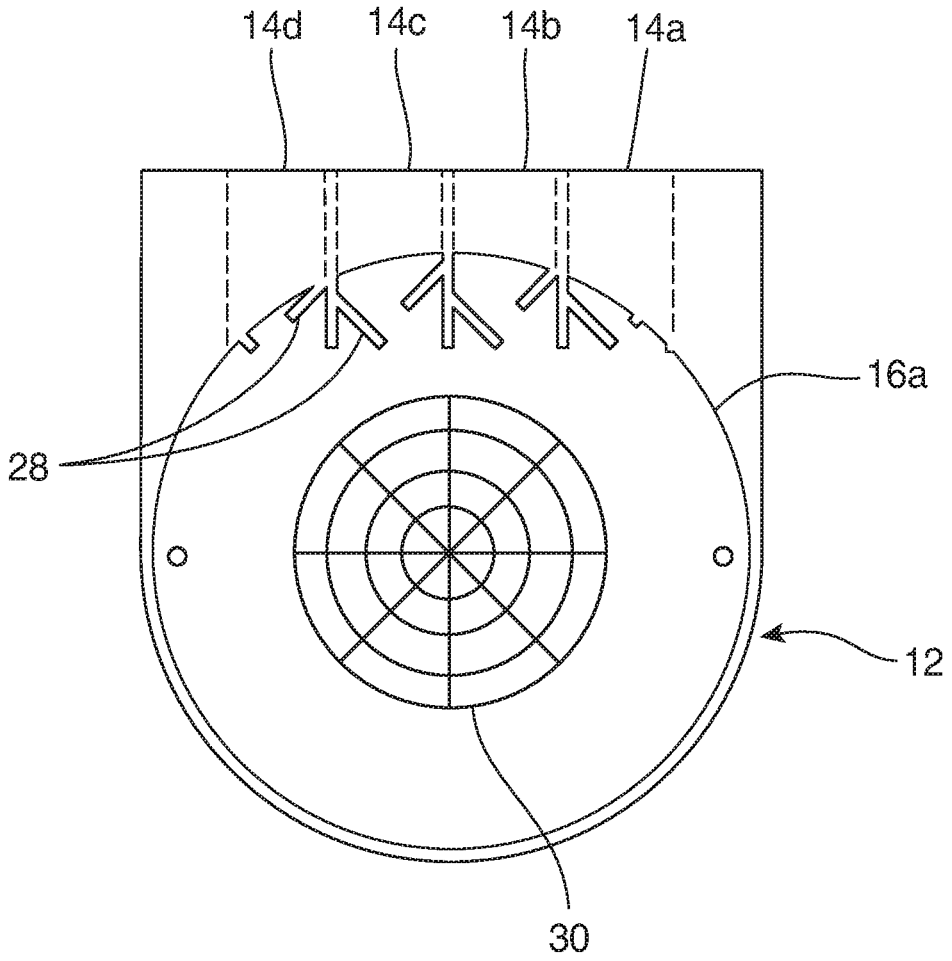
FIG. 4 is a top view of the example air gap floor drain.

FIG. 4 is a top view of the example air gap floor drain 10. The top funnel 16*a* and/or lid 12 may have a plurality of ports 14*a-d* (e.g., four ports are shown). The ports 14*a-d* may be any suitable size. In an example, the ports 14*a-d* are sized to receive standard three-quarter inch PVC drain pipe or pipe fittings for attaching the drain lines from different equipment.

In an example, one or more baffle 28 may be provided. In the example shown in FIG. 4, the baffles 28 are provided in the port 14*a-d* openings on the interior side of the lid 12 and funnel 16*a*. In another example, one or more baffle 28 may also be provided in the interior space of one or more of the funnels 16*a* and/or 16*b*. For example, the baffle(s) 28 may be provided on the interior sloped or cone surface 17*a*, 17*b* of the funnel(s) 16*a*, 16*b*. The baffles 28 may serve to slow and diffuse rapidly running water as it enters the air gap floor drain, and to minimize splashing.

In an example, one or more screen 30 may be provided. In the example shown, the screen 30 is provided at the exit of one of the funnels 16*a*. The screen 30 may also be provided at the exit of the other funnel(s) 16*b* and/or at one or more of the port(s) 14*a-d*. The screen(s) 30 may serve to reduce debris from flowing into and/or collecting and clogging the air gap device and/or the floor drain 3 aperture.

Figure 5A:
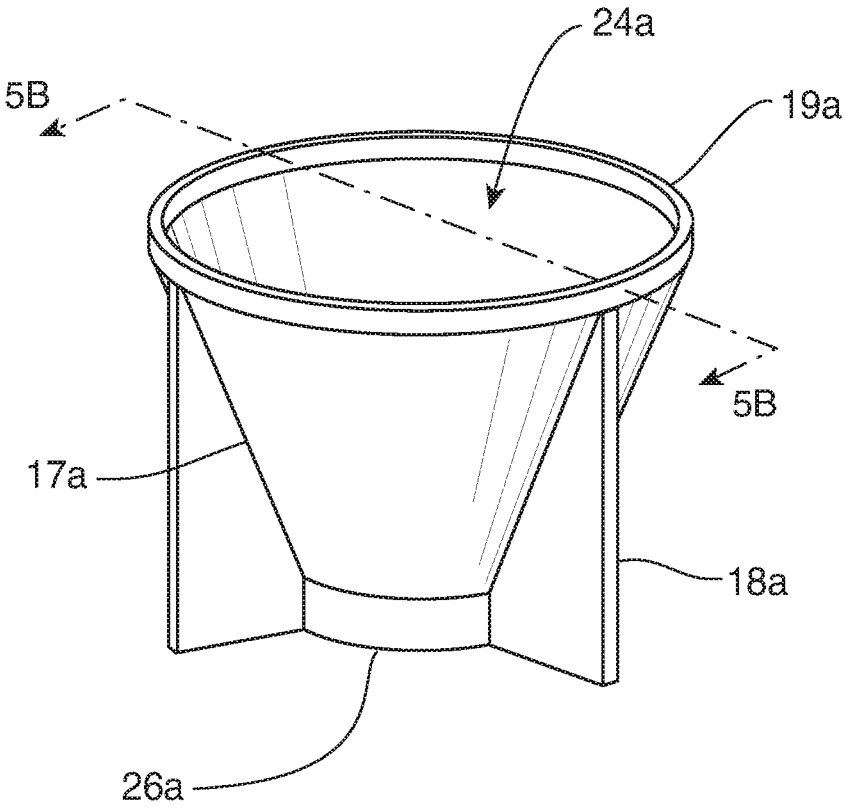
FIG. 5A is a perspective view of a funnel of the example air gap floor drain.
Figure 5B:
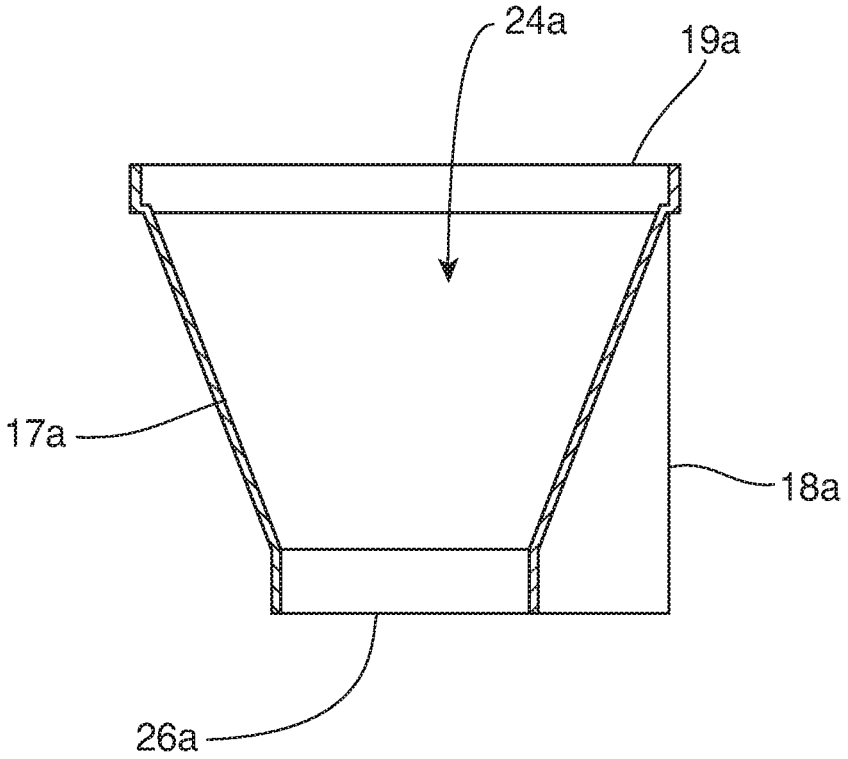
FIG. 5B is a cross-sectional view of the funnel of the example air gap floor drain taken along lines 5B-5B in FIG. 5A.

FIG. 5A is a perspective view of a funnel (e.g., 16*a* or 16*b*) of the example air gap floor drain 10. FIG. 5B is a cross section view of the funnel of the example air gap floor drain 10 taken along lines 5B-5B in FIG. 5A. In an example, the air gap floor drain 10 includes two more of these nested cones or funnels 16*a*, 16*b* supported by corresponding vertical stands or fins 17*a*, 17*b* for support. The cones or funnels include an aperture 24*a* at the top connected through a hollow space to an aperture 26*a* at the bottom of the funnel.

In an example, the top funnel 16*a* includes a removable cover or lid 12. In an example, the bottom rim 26*a* of each cone is below the top rim 24*a* of cone beneath it, such that an irregular flow of water may be accommodated with minimal risk of splashing, and such that the flow is well directed downward to the floor drain 3. In an example, the bottom cone 16*b* is a minimum one half inch above the surface of the floor drain 3. In an example, the air gap floor drain 10 has various screw holes to fit attachment points of floor drain 3 apertures produced by different manufacturers.

In an example, the cone shaped funnels 16*a*, 16*b* may be replaced with other geometric shapes that have the same property of directing fluid flow in a downward direction (e.g., being narrower at the bottom than at the top).

The configurations and operations shown and described herein are provided to illustrate example implementations. It is noted that the configurations and operations are not limited to the examples shown and described. Still other configurations and operations may also be implemented.

By way of illustration, the air gap floor drain 10 may include attachments and fittings for drain lines that cannot be moved off the floor. In another example, the air gap floor drain 10 may include barbed fittings for retaining flexible drain lines (the barbs preventing the drain lines from pulling out).

The air gap floor drain 10 can be enlarged to fit any existing two-hole floor drain. The ports may be larger or smaller than three quarters of an inch. An example air gap floor drain 10 may include more or fewer than four ports or pipe attachments in the air gap floor drain.

In an example, the air gap floor device 10 can be provided with a separate pre-formed, same-size pipe stand. In another example, the installer can fashion a stand that is appropriate to a particular installation.

It is noted that the examples shown and described are provided for purposes of illustration and are not intended to be limiting. Still other examples are also contemplated.

The invention claimed is:

1. An air gap floor drain assembly to provide an air gap between a floor drain aperture and one or more device drain conduits producing drain effluent, comprising:

a first funnel;

a lid on the first funnel, the lid having one or more ports to accept the device drain conduits; and a second funnel stacked under the first funnel so that the drain effluent from the device drain conduits entering the first funnel through the one or more ports and passes through the second funnel before flowing from the second funnel down into the floor drain aperture.

2. The air gap floor drain assembly of claim 1, wherein the second funnel is raised above the floor drain aperture so that the air gap is present between the floor drain aperture and the bottom of the second funnel.

3. The air gap floor drain assembly of claim 1, wherein the first funnel attaches to, and nests partially within, the second funnel.

4. The air gap floor drain assembly of claim 1, further comprising at least one baffle configured to slow the flow of the drain effluent and reduce risk of spillage.

5. The air gap floor drain assembly of claim 1, further comprising a screen at a bottom of at least one of the first and second funnels.

6. The air gap floor drain assembly of claim 1, further comprising a drain cover having a plurality of openings therethrough, the drain cover provided below the second funnel.

7. The air gap floor drain assembly of claim 1, further comprising a plurality of fins around at least one of the first and second funnels to stabilize the first and second funnels over the floor drain aperture.

8. The air gap floor drain assembly of claim 1, further comprising attaching the second funnel to a floor drain having the floor drain aperture.

9. The air gap floor drain assembly of claim 1, further comprising providing a separate standoff mechanism that attaches to at least one of the first and second funnels to support the second funnel above the floor drain aperture.

10. An air gap floor drain device for providing an air gap between a floor drain aperture and one or more device drain conduits producing drain effluent, comprising:

a first funnel;

a lid on the first funnel;

a plurality of ports on the lid of the first funnel, the ports configured to accept the device drain conduits; and a second funnel, the first funnel stacked on the second funnel so that the drain effluent from the device drain conduits entering the first funnel through the one or more ports and passes through the second funnel before flowing from the second funnel down into the floor drain aperture;

wherein the second funnel is raised above the floor drain aperture so that the air gap is present between the floor drain aperture and the bottom of the second funnel.

11. The air gap floor drain assembly of claim 10, wherein the first funnel attaches to, and nests partially within, the second funnel.

12. The air gap floor drain assembly of claim 10, further comprising at least one baffle on each of the plurality of ports, the at least one baffle configured to slow flow of the drain effluent.

13. The air gap floor drain assembly of claim 10, further comprising a screen at a bottom of at least one of the first and second funnels.

14. The air gap floor drain assembly of claim 10, further comprising a drain cover having a plurality of openings therethrough, the drain cover provided below the second funnel.

15. The air gap floor drain assembly of claim 10, further comprising a plurality of support fins around at least one of the first and second funnels to stabilize the first and second funnels over the floor drain aperture.

16. The air gap floor drain assembly of claim 10, further comprising attaching the second funnel to a floor drain having the floor drain aperture.

17. The air gap floor drain assembly of claim 10, further comprising providing a separate standoff mechanism that attaches to at least one of the first and second funnels to support the second funnel above the floor drain aperture.

18. An air gap floor drain for providing an air gap between a floor drain aperture and one or more device drain conduits producing drain effluent, comprising:

a first funnel;

a lid fitting on top of the first funnel to cover an interior of the first funnel;

a plurality of ports on the lid of the first funnel, the ports configured to accept the drain effluent from the device drain conduits into the interior of the first funnel;

at least a second funnel, the first funnel stacked on and partially nested within the second funnel;

a plurality of support fins provided around the first funnel and the at least second funnel;

a fluid connection between the first funnel and the at least second funnel;

wherein the second funnel is raised above the floor drain aperture so that the air gap is present between the floor drain aperture and the bottom of the second funnel.

* * * * *